US011118297B2

(12) United States Patent
Lee et al.

(10) Patent No.: US 11,118,297 B2
(45) **Date of Patent: *Sep. 14, 2021**

(54) LAUNDRY TREATMENT APPARATUS

(71) Applicant: LG Electronics Inc., Seoul (KR)

(72) Inventors: Jihong Lee, Seoul (KR); Wooseong Kim, Seoul (KR); Hongchul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,171

(22) Filed: Feb. 21, 2020

(65) Prior Publication Data

US 2020/0190723 A1 Jun. 18, 2020

Related U.S. Application Data

(60) Continuation of application No. 16/525,134, filed on Jul. 29, 2019, which is a division of application No.
(Continued)

(30) Foreign Application Priority Data

Jun. 30, 2015 (KR) ..... 10-2015-0092775

(51) Int. Cl.
*D06F 37/18* (2006.01)
*D06F 34/28* (2020.01)
(Continued)

(52) U.S. Cl.
CPC ..... *D06F 37/18* (2013.01); *D06F 34/28* (2020.02); *D06F 37/266* (2013.01); *D06F 37/28* (2013.01);
(Continued)

(58) Field of Classification Search
CPC ..... D06F 37/18; D06F 37/266; D06F 34/28; D06F 37/28; D06F 29/00; D06F 34/32; D06F 39/00
See application file for complete search history.

(56) References Cited

U.S. PATENT DOCUMENTS 5,915,698 A 6/1999 James
6,105,403 A 8/2000 Carow, Jr. et al.
(Continued)

FOREIGN PATENT DOCUMENTS

CN 1260416 7/2000
CN 101302706 11/2008
(Continued)

OTHER PUBLICATIONS

Chinese Office Action in Chinese Application No. 201610512706.5, dated Feb. 24, 2018, 21 pages.
(Continued)

*Primary Examiner* — Benjamin L Osterhout
(74) *Attorney, Agent, or Firm* — Fish & Richardson P.C.

(57) ABSTRACT

A laundry treatment apparatus includes a tub body for receiving water, a tub cover that covers an upper surface of the tub body and that defines an introduction aperture, a drum located inside the tub body for receiving laundry, a door for opening and closing the introduction aperture, a hinge that rotatably couples the door to the tub cover, a fixing unit that releasably couples a portion of the door to the tub cover, and a sealing unit on the door or the introduction aperture that is configured to seal the introduction aperture based on the introduction aperture being closed by the door. A portion of the sealing unit located in a direction in which the fixing unit is provided has a different diameter from a diameter of a portion of the sealing unit that is located in a direction in which the hinge is provided.

16 Claims, 6 Drawing Sheets

Related U.S. Application Data

15/198,255, filed on Jun. 30, 2016, now Pat. No. 10,364,523.

(51) Int. Cl.

| | |
|---|---|
| ***D06F 37/28*** | (2006.01) |
| ***D06F 37/26*** | (2006.01) |
| ***D06F 39/00*** | (2020.01) |
| *D06F 29/00* | (2006.01) |
| *D06F 34/32* | (2020.01) |

(52) U.S. Cl.

CPC ..... *D06F 39/00* (2013.01); *D06F 29/00* (2013.01); *D06F 34/32* (2020.02)

(56) References Cited

U.S. PATENT DOCUMENTS

| | | | |
|---|---|---|---|
| 9,745,682 | B2 | 8/2017 | Park et al. |
| 9,840,799 | B2 | 12/2017 | Sang et al. |
| 2007/0044521 | A1 | 3/2007 | Choi |
| 2009/0113945 | A1 | 5/2009 | Kim et al. |
| 2009/0133198 | A1 | 5/2009 | Lee et al. |
| 2009/0153057 | A1 | 6/2009 | Cho |
| 2009/0288452 | A1 | 11/2009 | Lee et al. |
| 2010/0011609 | A1 | 1/2010 | Park et al. |
| 2010/0101282 | A1 | 4/2010 | Jeong et al. |
| 2010/0320890 | A1 | 12/2010 | Jung et al. |
| 2011/0265524 | A1 | 11/2011 | Kim et al. |
| 2011/0298338 | A1 | 12/2011 | Kim |
| 2013/0047677 | A1 | 2/2013 | Han et al. |
| 2013/0152641 | A1 | 6/2013 | Carrillo |
| 2014/0053612 | A1 | 2/2014 | Son et al. |
| 2014/0196507 | A1 | 7/2014 | Lee et al. |
| 2015/0059418 | A1 | 3/2015 | Lee et al. |
| 2015/0345063 | A1 | 12/2015 | Sang et al. |

FOREIGN PATENT DOCUMENTS

| | | |
|---|---|---|
| CN | 101617077 | 12/2009 |
| CN | 104420122 | 3/2015 |
| CN | 104641031 | 5/2015 |
| EP | 1884584 | 2/2008 |
| EP | 2949803 | 12/2015 |
| JP | 9182708 | 7/1997 |
| JP | 2000238827 | 9/2000 |
| JP | 2001105888 | 4/2001 |
| JP | 2002248950 | 9/2002 |
| JP | 2003126585 | 5/2003 |
| JP | 2007130359 | 5/2007 |
| JP | 2014144070 | 8/2014 |
| KR | 101387472 | 4/2014 |
| KR | 1020080053000 | 4/2014 |
| KR | 1020150025083 | 3/2015 |
| WO | 2008069607 | 6/2008 |

OTHER PUBLICATIONS

Extended European Search Report issued in European Application No. 16176923.7 dated Oct. 28, 2016, 11 pages.

International Search Report and Written Opinion in International Application No. PCT/KR2016/007040, dated Sep. 12, 2016, 12 pages.

Russian Office Action in Russian Application No. 2017107193, dated May 25, 2018, 11 pages.

Taiwan Office Action in Taiwan Application No. 105118996, dated May 24, 2017, 11 pages (with English translation).

【FIG 1】
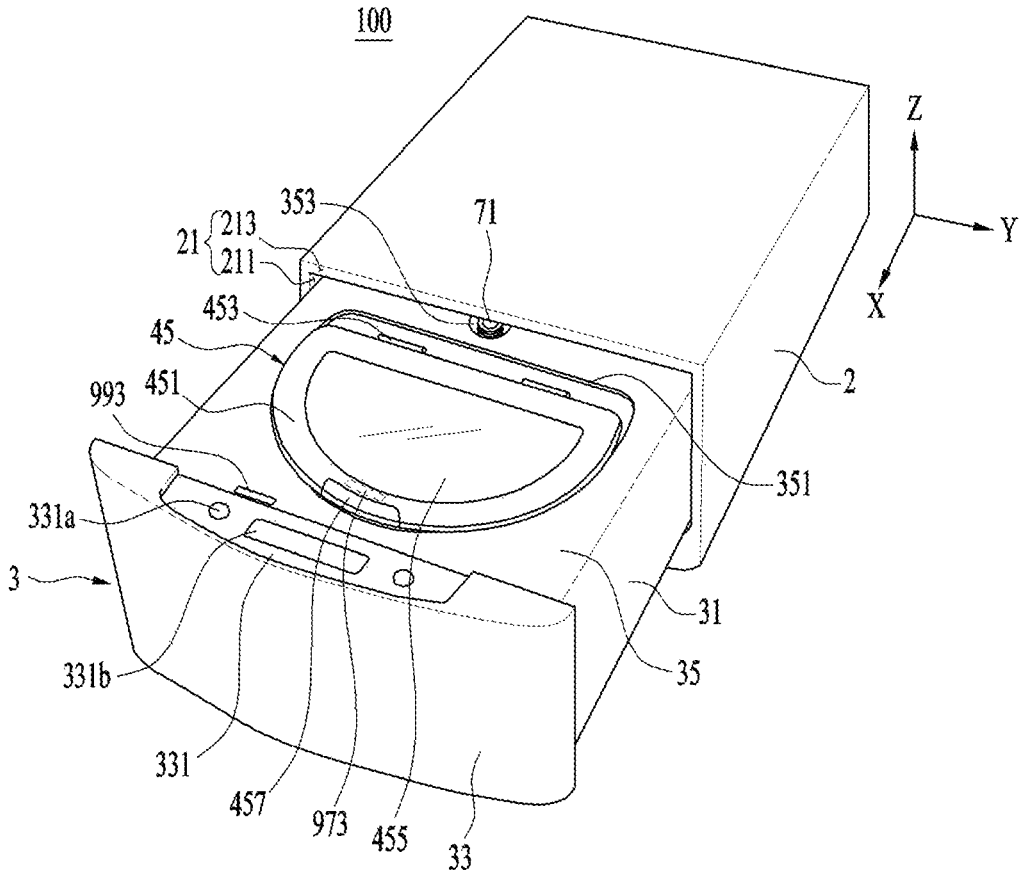

【 FIG 2】
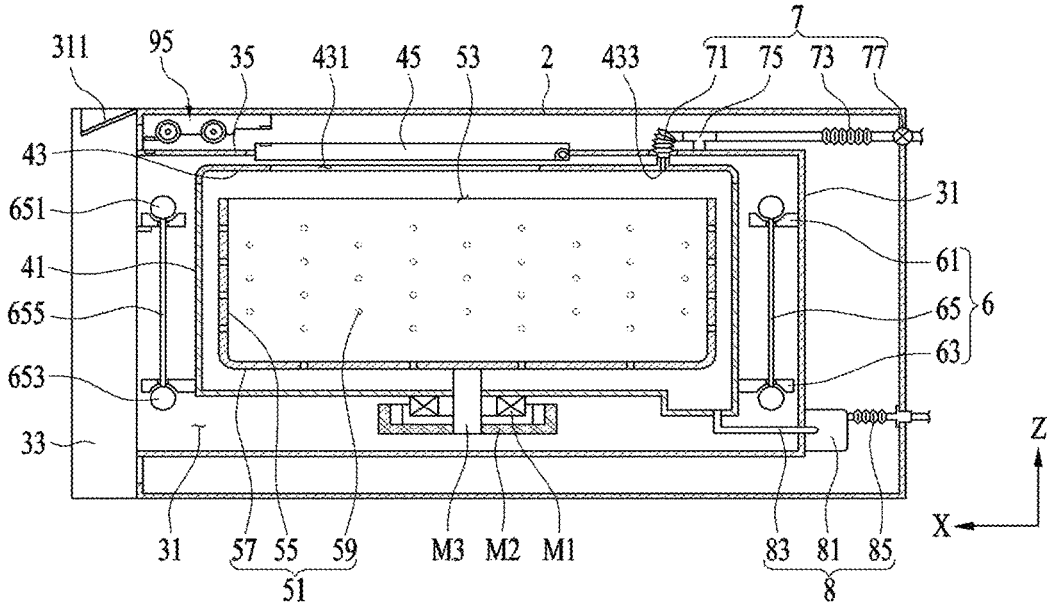

【 FIG 3】
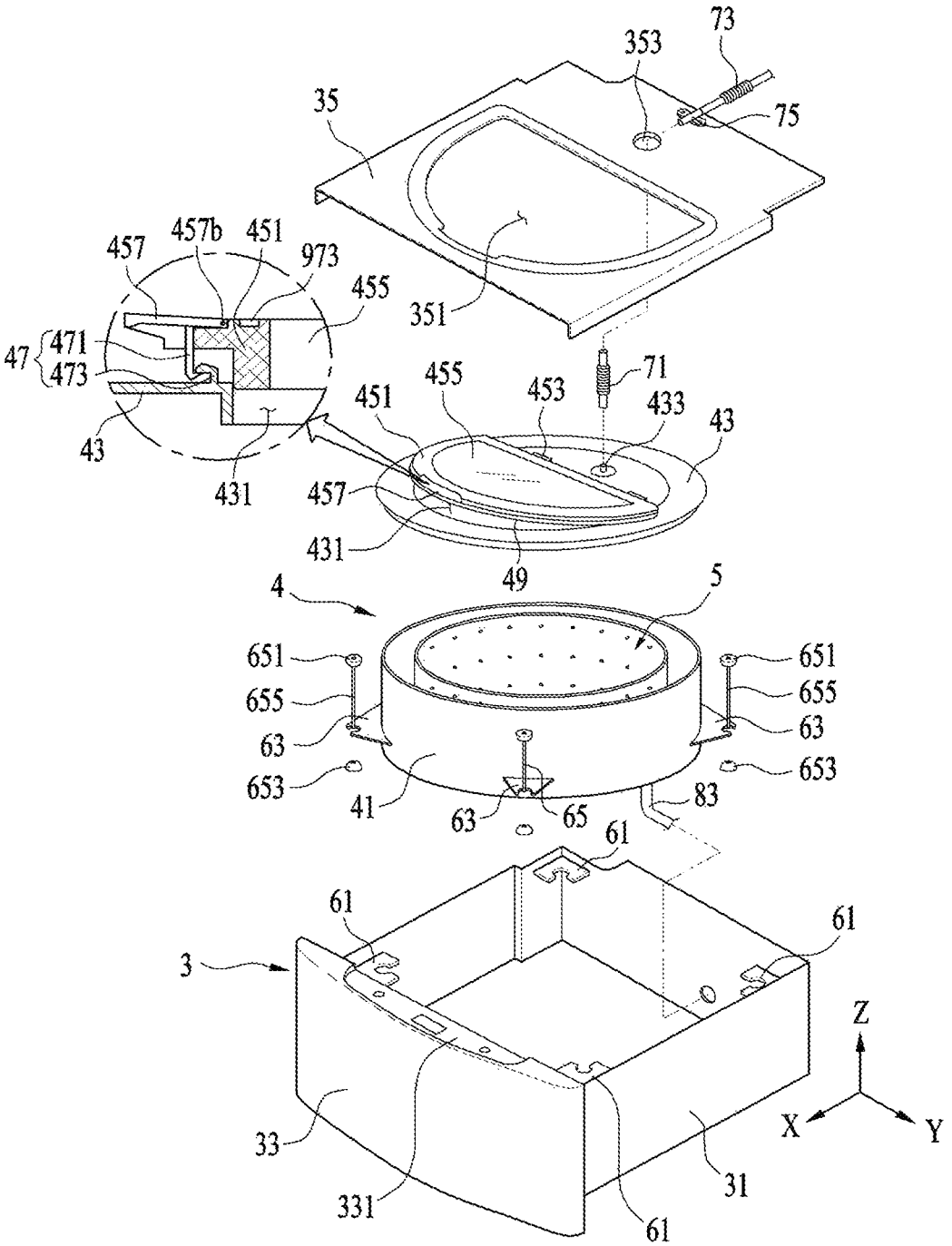

FIG 4(a)
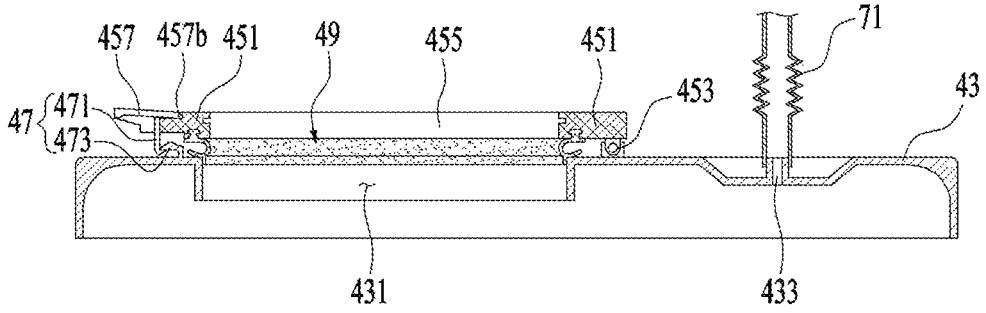
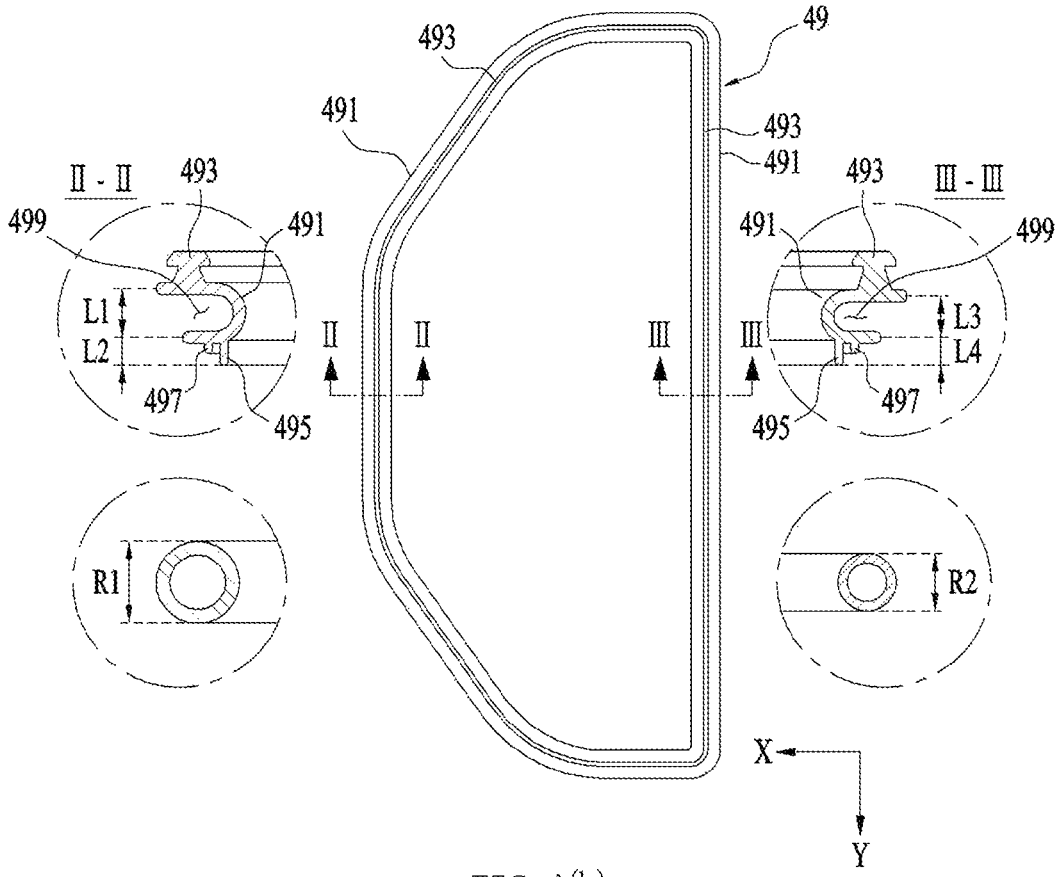
FIG 4(b)

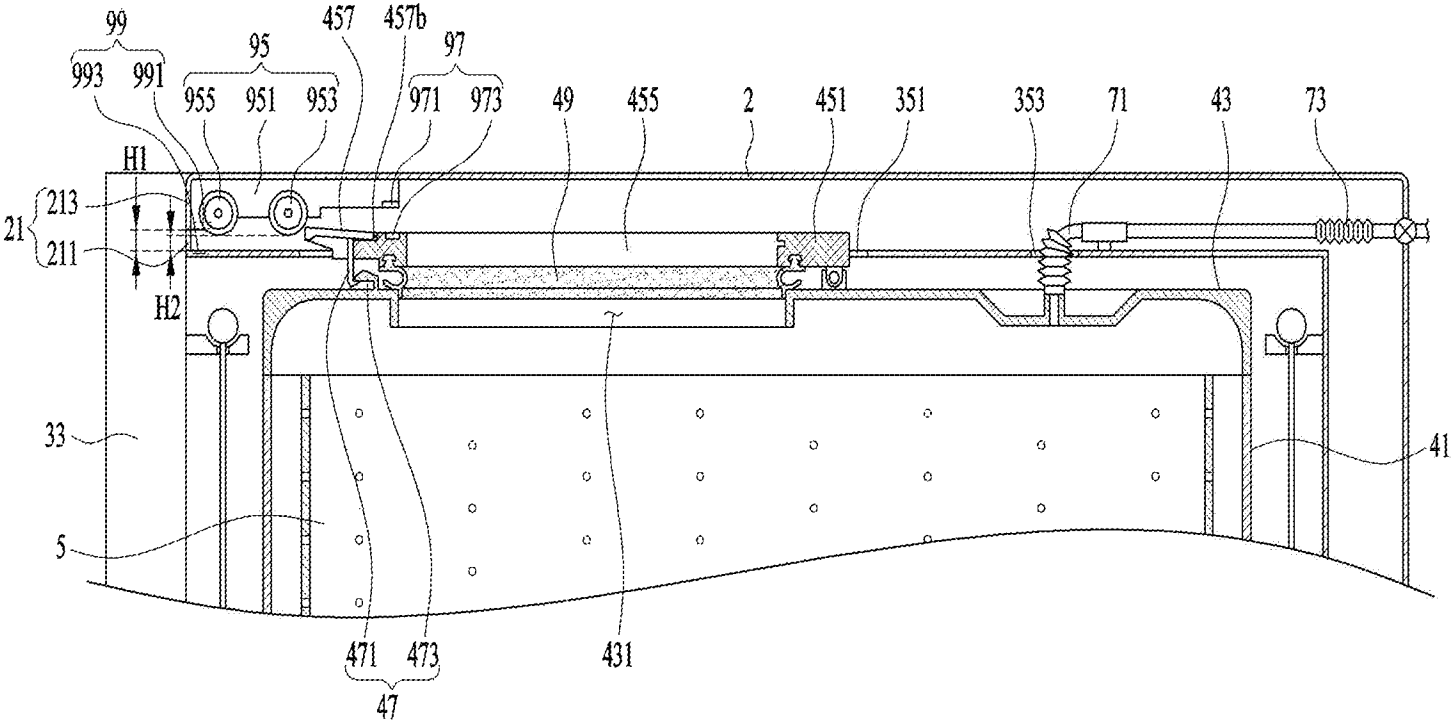
【FIG 5】

【FIG 6】
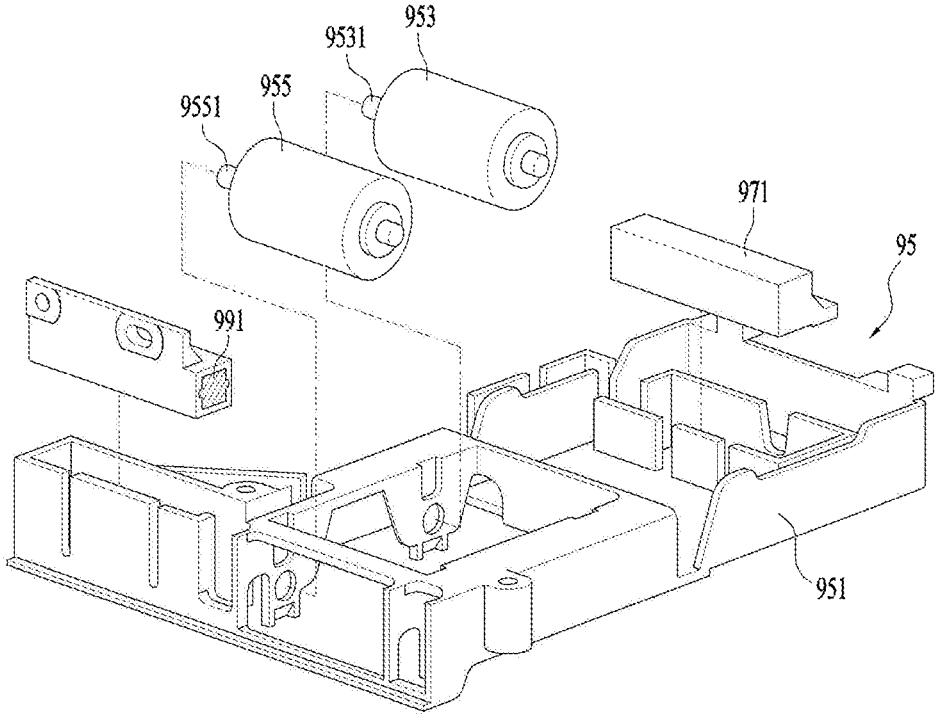

LAUNDRY TREATMENT APPARATUS

CROSS REFERENCE TO RELATED APPLICATION

This application is a continuation of U.S. application Ser. No. 16/525,134, filed on Jul. 29, 2019, which is a divisional of U.S. application Ser. No. 15/198,255, filed on Jun. 30, 2016, now U.S. Pat. No. 10,364,523, which claims the benefit of Korean Patent Application No. 10-2015-0092775, filed on Jun. 30, 2015. The disclosures of the prior applications are incorporated by reference in their entirety.

BACKGROUND

The present disclosure relates to a laundry treatment apparatus.

FIELD

Generally, a laundry treatment apparatus is a generic term for an apparatus that washes laundry (e.g. objects to be washed or objects to be dried), an apparatus that dries laundry, and an apparatus that may perform both washing and drying of laundry.

Conventional laundry treatment apparatuses are classified into front loading type laundry treatment apparatuses configured such that laundry is introduced through an introduction aperture formed in the front surface of the apparatus, and top loading type laundry treatment apparatuses configured such that laundry is introduced through an introduction aperture formed in the upper surface of the apparatus.

A top loading type laundry treatment apparatus may include a cabinet, a tub provided inside the cabinet and having an introduction aperture in the upper surface thereof, a drum rotatably provided inside the tub, and a door for opening and closing the introduction aperture.

SUMMARY

One object of the subject matter described in this application is to provide a laundry treatment apparatus, which may allow a drawer to be discharged from a cabinet even if a door to open an introduction aperture is opened in the state in which the drawer is inserted into the cabinet.

In addition, another object of the subject matter described in this application is to provide a laundry treatment apparatus, which includes a sealing unit having a good effect of hermetically sealing an introduction aperture.

In addition, another object of the subject matter described in this application is to provide a laundry treatment apparatus, which senses that a door is opened in the state in which a drawer is received in a cabinet.

In addition, another object of the subject matter described in this application is to provide a laundry treatment apparatus, which provides a device for fixing a door to open an introduction aperture when the door is closed.

In addition, another object of the subject matter described in this application is to provide a laundry treatment apparatus, which may allow a sealing member to be evenly attached to a door.

In addition, another object of the subject matter described in this application is to provide a laundry treatment apparatus, which may allow a sealing member to be firmly attached to a door.

In addition, another object of the subject matter described in this application is to provide a laundry treatment apparatus, which includes a device capable of notifying a user that a door is opened in the state in which a drawer is received in a cabinet, so as to assist the user in rapidly responding to the opening of the door.

In addition, another object of the subject matter described in this application is to provide a laundry treatment apparatus, which provides a sealing member having no adhesive surface at both ends thereof in the case where an introduction aperture has a closed-curve shape (e.g. a circular, oval, or polygonal shape) and the sealing member has a hollow bar shape.

In addition, another object of the subject matter described in this application is to provide a laundry treatment apparatus, which realizes a constant elastic force throughout the entire sealing member so that two ends of the sealing member do not need to be attached to each other.

In addition, a further object of the subject matter described in this application is to provide a laundry treatment apparatus, which provides a sealing member around a door for opening an introduction aperture having different thicknesses in the rear portion of the door, configured to be rotated about a hinge, and the front portion of the door, thereby allowing the door to be easily opened by elastic force when the door is separated from the introduction aperture.

According to one aspect, a laundry treatment apparatus includes a tub body that defines a space that is configured to receive water, a tub cover that covers an upper surface of the tub body, the tub cover defining an introduction aperture, a drum that is located inside the tub body and that defines a storage space that is configured to receive laundry, a door that is configured to open and close the introduction aperture, a hinge that is configured to rotatably couple the door to the tub cover, a fixing unit that is configured to releasably couple a portion of the door to the tub cover, and a sealing unit that is provided to one of the door or the introduction aperture and that is configured to seal the introduction aperture based on the introduction aperture being closed by the door. A portion of the sealing unit that is located in a direction in which the fixing unit is provided, has a different diameter from a diameter of a portion of the sealing unit that is located in a direction in which the hinge is provided.

Implementations according to this aspect may include one or more of the following features. For example, the sealing unit may have an O-shaped cross section, and the portion of the sealing unit that is located in the direction in which the fixing unit is provided may have a greater diameter than the diameter of the portion of the sealing unit that is located in the direction in which the hinge is provided. The sealing may have a C-shaped cross section, and the portion of the sealing unit that is located in the direction in which the fixing unit is provided may have a greater diameter than the diameter of the portion of the sealing unit that is located in the direction in which the hinge is provided. In some cases, the laundry treatment apparatus may include a tub body that defines a space that is configured to receive water, a tub cover that covers an upper surface of the tub body, the tub cover defining an introduction aperture, a drum that is located inside the tub body and that defines a storage space that is configured to receive laundry, a door that is configured to open and close the introduction aperture, and a sealing unit that is provided to one of the door or the introduction aperture and that is configured to seal the introduction aperture based on the introduction aperture being closed by the door. The sealing unit may have a C-shaped cross section. The cross section of the sealing unit ay be asymmetrical about a horizontal line passing through a center of the cross section. The sealing unit may include a sealing body that has a C-shaped cross section and that is located vertically above the introduction aperture, and an insertion portion that extends from the sealing body and that is configured to be inserted into the introduction aperture. In some cases, the laundry treatment apparatus may further include a body fixing portion that is configured to couple the sealing body to the door, and a protrusion that is provided on the sealing body and that is configured to create contact between the insertion portion and the introduction aperture based on the sealing body being pushed toward the introduction aperture.

In some implementations, the laundry treatment apparatus may further include a hinge that is configured to rotatably couple the door to the tub body, and a fixing unit that is configured to releasably couple a portion of the door to the tub body, wherein a distance between free ends of the sealing body that is located in a direction in which the fixing unit is provided may be longer than a distance between free ends of the sealing body that is located in a direction in which the hinge is provided. A portion of the sealing body that is located in the direction in which the fixing unit is provided may have a greater diameter than a diameter of a portion of the sealing body that is located in the direction in which the hinge is provided. A portion of the insertion portion, provided in a region parallel to the hinge, may have a length required to guide water remaining on the door into the introduction aperture based on the introduction aperture being opened by the door. In some cases, the laundry treatment apparatus may further include a cabinet having an opening, and a drawer for providing a space in which the tub body is received, the drawer being configured so as to be discharged from the cabinet through the opening. The laundry treatment apparatus may further include a guide for preventing the door from interfering with the opening when the drawer is discharged from the cabinet. The guide may include a wheel that is located inside the cabinet and configured to rotate, and a distance from the upper surface of the drawer to a lowermost end of the wheel may be shorter than a distance from the upper surface of the drawer to the uppermost end of the opening.

In some cases, the laundry treatment apparatus may further include a position sensing unit that is configured to determine one or both of: whether the drawer is inserted into the cabinet to a predetermined reference position; and whether the door is opened during a state in which the drawer is inserted into the cabinet. The laundry treatment apparatus may further include a display unit that is configured to notify a user that the drawer is inserted into the cabinet but not at the reference position, or that the door is opened based on the drawer being inserted into the cabinet, or both. The display unit may be configured to display characters or symbols, configured to generate sound, or configured to emit light. The notification unit may include at least one of an LCD, a speaker, or a lamp. In some cases, the laundry treatment apparatus may further include an opening provided in the sealing body for providing the sealing body with a "C"-shaped cross section, and the opening may be located in a surface defined by the sealing body in a direction opposite to a direction in which the introduction aperture is located.

BRIEF DESCRIPTION OF THE DRAWINGS

FIGS. 1 and 2 are views showing an example laundry treatment apparatus.

FIG. 3 is a view showing an example coupling structure of a drawer, a tub, and a drum.

FIGS. 4(*a*) and 4(*b*) are views showing an example sealing unit.

FIGS. 5 and 6 are views an example guide.

DETAILED DESCRIPTION

As illustrated in FIGS. 1 and 2, a laundry treatment apparatus 100 may include a cabinet 2, a drawer 3 provided so as to be discharged from the cabinet 2, a tub 4 provided inside the drawer 3 for storing water therein, and a drum 5 rotatably provided inside the tub 4 for storing laundry therein.

The cabinet 2 may serve to define the external appearance of the laundry treatment apparatus 100, and may also simply serve as a space in which the drawer 3 is received. In any case, the cabinet 2 may be provided in the front surface thereof with an introduction/discharge opening (an opening) 21 for the insertion of the drawer 3.

The introduction/discharge opening (an opening) 21 may include an opening 211 formed in one surface of the cabinet 2, and a flange 213 provided along the edge of the opening 211.

The drawer 3 includes a drawer body 31 configured so as to be inserted into the cabinet 2 through the introduction/discharge opening (an opening) 21, a drawer panel 33 fixed to the front surface of the drawer body 31 for opening and closing the opening 211, and a drawer cover 35 for forming the upper surface of the drawer body 31.

Because the drawer panel 33 is fixed to the front surface of the drawer body 31, the drawer panel 33 may serve as a handle for discharging the drawer body 31 from the cabinet 2.

Once the drawer panel 33 has moved to the position at which the opening 211 is closed by the drawer panel 33, the drawer panel 33 may come into contact with the flange 213. Accordingly, the flange 213 serves not only to arrange the drawer body 31 at a reference position, which is set inside the cabinet 2, but also to prevent the drawer panel 33 from being inserted into the cabinet 2.

The drawer panel 33 may be provided with a control panel 331, which is used to input a control command associated with the operation of the laundry treatment apparatus 100 and to notify a user of a message associated with the operation of the laundry treatment apparatus 100. The control panel 331 may include an input unit 331*a* for the input of a control command, and a display unit 331*b* for displaying signals associated with the operation of the laundry treatment apparatus 100 including the control command. The display unit 331*b* may be at least one selected from among a device for displaying characters or symbols, a device for generating sound, and a device for emitting light (e.g., a lamp).

The drawer body 31 may have any shape so long as it can be inserted into the cabinet 2 through the opening 211 and so long as it can provide a space in which the tub 4 is received. FIG. 1 illustrates the drawer body 31 having a hexahedral shape by way of example.

The drawer cover 35 has a first through-hole 351 and a second through-hole 353 for communicating the inside of the drawer body 31 with the outside. The first through-hole 351 must be provided for the introduction and discharge of laundry, and the second through-hole 353 must be provided to supply water required to wash the laundry. A detailed description related thereto will follow.

As illustrated in FIG. 2, the tub 4 may include a tub body 41 located inside the drawer body 31 for storing water therein, and a tub cover 43 for forming the upper surface of the tub body 41. The tub body 41 may take the form of a cylinder having an open upper surface.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided so as to communicate with the second through-hole 353 provided in the drawer cover 35.

The introduction aperture 431 serves to allow laundry to be introduced into the tub body 41, or to allow the laundry inside the tub body 41 to be discharged to the outside of the tub body 41. The introduction aperture 431 is opened and closed by a door 45, which is rotatably provided on any one of the drawer cover 35 or the tub cover 43.

FIG. 3 illustrates an example where the door 45 is coupled to the tub cover 43. Here, the door 45 may include a frame 451 rotatably coupled to the tub cover 43 via a hinge 453, a window 455 provided in the frame 451, and a handle 457 for separably coupling the frame 451 to the tub cover 43.

The window 455 may be formed of a transparent material to allow the user to view the inside of the tub body 41 when the drawer 3 is discharged from the cabinet 2.

As illustrated in FIGS. 4(*a*) and 4(*b*), the handle 457 is rotatably coupled to the frame 451 via a handle shaft 457*b*, and the handle 457 is separably fixed to the tub cover 43 via a fixing unit 47.

The fixing unit 47 may include a first fastening portion 471 (e.g. a hook) protruding from any one of the handle 457 and the tub cover 43, and a second fastening portion 473 (e.g. a hook receiving recess) formed in the other one of the handle 457 and the tub cover 43 for separably receiving the first fastening portion 471.

In order to prevent the water inside the tub body 41 from being discharged to the outside of the tub body 41 through the introduction aperture 431, any one of the frame 451 and the tub cover 43 may be provided with a sealing unit 49 for hermetically sealing a space between the frame 451 and the introduction aperture 431 when the door 45 to open the introduction aperture 431 is closed.

The sealing unit 49 may include a sealing body 491 fixed to the frame 451 so as to hermetically seal the space between the frame 451 and the edge of the introduction aperture 431, and an insertion portion 495 extending from the sealing body 491 so as to be inserted into the introduction aperture 431.

The sealing body 491 may take the form of a hollow bar, or may have a C-shaped cross section. In any case, the sealing body 491 may be formed of an elastic material, such as rubber.

In an example where the introduction aperture 431 has a closed-curve shape (e.g. a circular, oval, or polygonal shape) and the sealing body 491 has a hollow bar shape, the sealing body 491 must inevitably have an adhesive surface. The sealing body having a hollow bar shape (e.g. a sealing body having an O-shaped cross section) must be manufactured only into a linear shape. Therefore, in order to provide the sealing body 491 having a hollow bar shape with a closed-curve shape, the sealing body having an O-shaped cross section must be cut to a prescribed length, and both ends of the sealing body must be attached to each other using, for example, an adhesive.

However, when a portion of the sealing body 491 is attached using an adhesive, the portion attached using the adhesive and a remaining portion have different elasticities, which may cause deterioration in the effect of the sealing unit 49. Therefore, the sealing unit 49 may have a C-shaped cross section, rather than an O-shaped cross section.

That the sealing body 491 has a C-shaped cross section means that the cross section of the sealing body 491 does not form a closed-curve. That is, the sealing body 491 attains a C-shaped cross section because the inside and the outside of the sealing body 491 communicate with each other through an opening 499.

The opening 499 may be provided in one of the surfaces of the sealing body 491, which is located opposite to the direction in which the introduction aperture 431 is located. Assuming that the opening 499 is located so as to face the introduction aperture 431, wash water remaining on the door 45 may remain in the opening 499, rather than moving to the tub 4, when the door 45 is opened.

In addition, when the sealing body 491 has a C-shaped cross section, the sealing body 491, which has the same closed-curve shape as the shape of the introduction aperture 431, may be formed without adhesion even if the introduction aperture 431 has the closed curve shape, which may prevent any problem caused by the sealing body 491 having the adhesive surface.

When the sealing body 491 has a C-shaped cross section, a distance L1 between free ends of the sealing body 491, located in the direction in which the fixing unit 47 of the handle 457 is provided, may be longer than a distance L3 between free ends of the sealing body 491 located in the direction in which the hinge 453 is provided. This serves to improve the convenience of a user by causing the door 45 to be separated from the introduction aperture 431 once the user has separated the fixing unit 47.

When the sealing body 491 has an O-shaped cross section, the above-described effect may be realized by configuring the sealing body 491 such that a diameter R1 of a portion of the sealing body 491, located in the direction in which the fixing unit 47 of the handle 457 is provided, is longer than a diameter R2 of a portion of the sealing body 491 is located in the direction in which the hinge 453 is provided.

The sealing body 491 having the configuration described above may be coupled to the frame 451 of the door 45 via a body fixing portion 493.

The insertion portion 495 may have any shape so long as it can be inserted into the introduction aperture 431 so as to increase the efficiency of sealing of the introduction aperture 431. A length L4 of a portion of the insertion portion 495, provided in a region parallel to the hinge 453, may be longer than a length L3 of a remaining portion of the insertion portion 495. This serves to allow water remaining on the door 45 to be introduced into the tub body 41 through the introduction aperture 431 when the door 45 to open the introduction aperture 431 is opened.

In addition, the sealing unit 49 may further include a protrusion 497 for causing the insertion portion 495 to come into close contact with the introduction aperture 431 when the sealing body 491 is pushed toward the introduction aperture 431. To this end, the protrusion 497 may be provided on the sealing body 491 at a position between the insertion portion 495 and the free ends located on a lower portion of the sealing body 491.

The tub 4 having the configuration described above is coupled to the drawer body 31 via a tub support unit 6. As illustrated in FIG. 2, the tub support unit 6 may include a first support member 61 provided at the drawer body 31, a second support member 63 provided at the tub body 41, and a connector 65 for connecting the first support member 61 and the second support member 63 to each other.

The connector 65 may include a first connection piece 651 configured so as to be seated in the first support member 61, a second connection piece 653 for supporting the second support member 63, and a bar 655 for connecting the first connection piece 651 and the second connection piece 653 to each other.

The first connection piece 651 may be shaped so as to be movable in the first support member 61 while being seated in the first support member 61. The second connection piece 653 may be shaped so as to support the second support member 63 and to be movable in the second support member 63.

FIG. 2 illustrates an example where the first connection piece 651 and the second connection piece 653 have a spherical shape by way of example, and FIG. 3 illustrates an example where the first connection piece 651 and the second connection piece 653 have a semispherical surface in contact with the respective support members 61 and 63 by way of example.

As illustrated in FIG. 2, the bar 655 may form a right angle with respect to the bottom surface of the cabinet 2 (e.g. provided parallel to the height direction Z of the cabinet 2 or provided so as to form a right angle with respect to the bottom surface of the drawer 3).

Because at least three tub support units 6 are provided to couple the tub body 41 to the drawer body 31 and the bars 655 form a right angle with respect to the bottom surface of the cabinet 2, the distance between the tub cover 43 and the drawer cover 35 may be increased compared to the case where the bars 655 are tilted by a prescribed angle relative to the Z-axis.

Accordingly, the tub support units 6 may reduce the possibility of the tub cover 43 colliding with the drawer cover 35 even if the tub body 41 vibrates inside the drawer body 31.

When the bars 655 are provided so as to form a right angle with respect to the bottom surface of the drawer 3, at least one of the first support member 61 and the second support member 63 may be separably coupled to the drawer body 31.

When at least three tub support units 6 are provided and both the first support member 61 and the second support member 63 are not separable from the drawer body 31, a worker who attempts to fix the tub body 41 to the drawer body 31 first needs to insert the tub body 41 into the drawer body 31 so as to prevent the first support member 61 from interfering with the second support member 63, and thereafter needs to rotate the tub body 41 so that the second support member 63 is located on the vertical axis, which passes through the first support member 61, in order to couple the first connection piece 651 to the first support member 61.

Although the feature by which the bar 655 of the tub support unit 6 is provided so as to form a right angle with respect to the bottom surface of the drawer 3 serves to minimize the distance between the outer circumferential surface of the tub body 41 and the inner circumferential surface of the drawer body 31 so as to minimize the volume of the laundry treatment apparatus 100, the strength of assembly of the first connection piece 651 and the first support member 61 may be deteriorated while the process described above is performed. This problem may be solved by making the first support member 61 be separable from the drawer body 31.

The drum 5, which is provided inside the tub 4, may include a cylindrical drum body 51 having an opening 53 (e.g. a drum opening) formed in the upper surface thereof. Because the drum opening 53 is located below the introduction aperture 431, the laundry supplied through the introduction aperture 431 may be supplied to the drum body 51 through the drum opening 53. In some cases, a plurality of drum through-holes 59 may be provided in a bottom surface 57 and a circumferential surface 55 of the drum body 51 for communicating the inside of the drum body 51 with the tub body 41.

The drum body 51 may be rotated inside the tub body 41 by a drive unit. The drive unit may include a stator M1 located outside the tub body 41 and fixed to the bottom surface of the tub body 41, a rotor M2 configured so as to be rotated by a rotating magnetic field provided by the stator M1, and a rotating shaft M3 penetrating the bottom surface of the tub body 41 for connecting the bottom surface 57 of the drum 5 and the rotor M3 to each other. In this case, the rotating shaft M3 may be provided so as to form a right angle with respect to the bottom surface of the tub body 41.

The laundry treatment apparatus 100 having the configuration described above may supply water to the tub 4 via a water supply unit 7, and may discharge water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which is controlled by a controller.

In some implementations, the water supply unit 7 may include a single water supply pipe for connecting a water supply source, which is located at the outside of the cabinet 2, to the supply aperture 433 provided in the tub cover 43. In this case, the water supply pipe may be a corrugated pipe.

The drain unit 8 may include a drain pump 81 fixed to the drawer body 31, a first drain pipe 83 for guiding water inside the tub body 41 to the drain pump 81, and a second drain pipe 85 for guiding water discharged from the drain pump 81 to the outside of the cabinet 2. In this case, the second drain pipe 85 may be a corrugated pipe.

In the laundry treatment apparatus 100 having the configuration described above, it may be difficult to discharge the drawer 3 from the cabinet 2 when the door 45 is opened in the state in which the drawer 3 is located inside the cabinet 2. That is, once the door 45 has been opened inside the cabinet 2, the door 45 may interfere with the introduction/discharge opening (an opening) 21 of the cabinet 2 when the drawer 3 is discharged from the cabinet 2, thereby preventing the discharge of the drawer 3.

In order to solve the problem described above, the laundry treatment apparatus 100 may further include a guide 95 for preventing the door 45 from interfering with the introduction/discharge opening (an opening) 21 when the drawer 3 is discharged from the cabinet 2.

As illustrated in FIG. 5, the guide 95 may include one or more wheels 953 and 955 rotatably provided inside the cabinet 2. In this case, a distance H2 from the upper surface of the drawer 3 to the lowermost end of the wheels 953 and 955 may be shorter than a distance H1 from the upper surface of the drawer 3 to the introduction/discharge opening (an opening) 21.

The wheels 953 and 955 may be rotatably fixed to the cabinet 2, or may be rotatably fixed to a case 951, which is fixed to the cabinet 2.

In the case where the introduction/discharge opening (an opening) 21 has the opening 211 and the flange 213, the guide 95 needs to prevent the door 45 from interfering with the flange 213 when the drawer 3 is discharged from the cabinet 2. In this case, the distance H2 from the drawer cover 35 to the lowermost end of the wheels 953 and 955 may be shorter than a distance from the drawer cover 35 to the flange 213.

As illustrated in FIG. 6, the wheels may include a first wheel 953 and a second wheel 955, which are spaced apart from each other by a prescribed distance in a direction in which the drawer 3 is discharged. The first wheel 953 may be rotatably fixed to the case 951 via a first shaft 9531, and the second wheel 955, which is located close to the introduction/discharge opening (an opening) 21, may be rotatably fixed to the case 951 via a second shaft 9551.

The distances from the upper surface of the drawer 3 to the lowermost ends of the respective wheels 953 and 955 may be set to the same value, or may be set to different values. In the latter case, the distance from the upper surface of the drawer 3 to the lowermost end of the second wheel 955 (i.e. the wheel located close to the introduction/discharge opening (an opening) 21) may be shorter than the distance from the upper surface of the drawer 3 to the lowermost end of the first wheel 953.

In addition, the distance from the upper surface of the drawer 3 to the lowermost end of the second wheel 955 may be set to a length for enabling the coupling of the first fastening portion 471 and the second fastening portion 473 provided in the fixing unit 47. This serves to eliminate a problem in which the door 45 prevents the drawer 3 from being discharged from the cabinet 2 by fixing the door 45 to the tub cover 43 using the guide 95 whenever the drawer 3 is discharged from or inserted into the cabinet 2.

When the door 45 is opened inside the cabinet 2 so as to open the introduction aperture 431, water inside the tub body 41 may be discharged from the tub body 41 through the introduction aperture 431. To prevent the occurrence of this problem, a first position sensing unit 97 for determining whether or not the door 45 to open the introduction aperture 431 is opened may be included.

The first position sensing unit 97 may include a first magnetic-force generator 973 provided in any one of the cabinet 2 and the door 45 for generating magnetic force, and a first magnetic-force sensor 971 provided in the other one of the cabinet 2 and the door 45 for sensing the magnitude of magnetic force provided by the first magnetic-force generator 973.

FIG. 5 illustrates an example where the first magnetic-force generator 973 is a permanent magnet fixed to the door 45 and the first magnetic-force sensor 971 is fixed to the case 951 so as to sense the magnitude of magnetic force of the permanent magnet by way of example.

In the laundry treatment apparatus 100 having the first position sensing unit 97, when the magnitude of magnetic force sensed by the first magnetic-force sensor 971 is below a predetermined first reference magnetic force, the controller may determine that the drawer 3 is located inside the cabinet 2 and the door 45 to open the introduction aperture 431 is closed.

However, in such a state, when the magnitude of magnetic force sensed by the first magnetic-force sensor 971 becomes the predetermined first reference magnetic force or more, the controller may determine that the door 45 located inside the cabinet 2 to open the introduction aperture 431 is opened.

Upon determining that the door 45 to open the introduction aperture 431, located inside the cabinet 2, is opened, the controller may notify the user that the door 45 inside the cabinet 2 is opened via, for example, the display unit 331*b* (using character signals, symbols, sound signals, or light emission).

In some cases, the laundry treatment apparatus 100 may further include a second position sensing unit 99 for determining whether or not the drawer 3 is inserted to the inside of the cabinet 2. The second position sensing unit 99 may include a second magnetic-force generator 993 provided in any one of the drawer 3 and the cabinet 2 for generating magnetic-force, and a second magnetic-force sensor 991 provided in the other one of the drawer 3 and the cabinet 2 for sensing the magnitude of magnetic force provided by the second magnetic-force generator 993.

The second magnetic-force sensor 991 and the second magnetic-force generator 993 may be provided at positions at which whether or not the introduction/discharge opening (an opening) 21 is closed by the drawer panel 33 may be determined. FIG. 5 illustrates an example where the second magnetic-force generator 993 is a permanent magnet fixed to the front side of the drawer cover 35 and the second magnetic-force sensor 991 is fixed to the case 951 for sensing the magnitude of magnetic force of the permanent magnet.

When the drawer 3 is not completely inserted into the cabinet 2, but is operated, the drawer 3 may be discharged from the cabinet 2 by vibration generated during rotation of the drum 5.

To solve the problem described above, the controller may notify the user that the magnitude of magnetic force sensed by the second magnetic-force sensing unit 99 is smaller than a predetermined second reference magnetic-force via the display unit 331*b* (using character signals, symbols, sound signals, and light emission).

In addition, even if the user indicates the execution of a control command via the input unit 331*a*, the controller may delay the execution of a control command selected by the user until the magnitude of magnetic force sensed by the second magnetic-force sensing unit 99 becomes the second reference magnetic force or more.

As is apparent from the above description, the laundry treatment apparatus may allow a drawer to be discharged from a cabinet even if a door to open an introduction aperture is opened in the state in which the drawer is inserted into the cabinet.

In addition, the laundry treatment apparatus may include a sealing unit having a good effect of hermetically sealing an introduction aperture.

In addition, the laundry treatment apparatus may senses that a door is opened in the state in which a drawer is received in a cabinet.

In addition, the laundry treatment apparatus may provide a device for fixing a door to open an introduction aperture when the door is closed.

In addition, the laundry treatment apparatus may allow a sealing member to be evenly attached to a door.

In addition, the laundry treatment apparatus may allow a sealing member to be firmly attached to a door.

In addition, the laundry treatment apparatus may include a device capable of notifying a user that a door is opened in the state in which a drawer is received in a cabinet, so as to assist the user in rapidly responding to the opening of the door.

In addition, the laundry treatment apparatus may provide a sealing member having no adhesive surface at both ends thereof in the case where an introduction aperture has a closed-curve shape (e.g. a circular, oval, or polygonal shape) and the sealing member has a hollow bar shape.

In addition, the laundry treatment apparatus may be configured to provide a constant elastic force throughout the entire sealing member so that two ends of the sealing member do not need to be attached to each other.

In addition, the laundry treatment apparatus may provide a sealing member around a door for opening an introduction aperture having different thicknesses in the rear portion of the door, configured to be rotated about a hinge, and the front portion of the door, thereby allowing the door to be easily opened by elastic force when the door is separated from the introduction aperture.

What is claimed is:

1. A laundry treatment apparatus comprising:

a tub body;

a tub cover disposed on the tub body, the tub cover having an introduction aperture;

a door that is configured to open and close the introduction aperture; and a sealing unit that is located at the door and that is configured to seal the introduction aperture based on the introduction aperture being closed by the door, wherein the sealing unit comprises:

a sealing body that is configured to, based on the introduction aperture being closed by the door, be positioned between the door and the tub cover to thereby seal the introduction aperture, and an insertion portion that extends from the sealing body and that is configured to be inserted into the introduction aperture.

2. The laundry treatment apparatus according to claim 1, wherein the sealing unit further comprises a protrusion that extends from a lower portion of the sealing body and that is located between an end of the lower portion of the sealing body and the insertion portion.

3. The laundry treatment apparatus according to claim 2, wherein the insertion portion is configured to, based on the door closing the introduction aperture, contact an edge of the introduction aperture or the tub cover.

4. The laundry treatment apparatus according to claim 2, wherein a length of the insertion portion extending from the sealing body is longer than a length of the protrusion extending from the sealing body.

5. The laundry treatment apparatus according to claim 4, wherein the protrusion is configured to contact an upper surface of the tub cover, and the insertion portion is configured to contact a surface of the tub cover surrounding the introduction aperture.

6. The laundry treatment apparatus according to claim 4, wherein a portion of the sealing body between the protrusion and the insertion portion is configured to contact the tub cover based on the door being closed.

7. The laundry treatment apparatus according to claim 6, wherein a side of the protrusion facing the insertion portion is configured to contact the tub cover based on the door being closed.

8. The laundry treatment apparatus according to claim 1, wherein a distance between an upper portion and a lower portion of the sealing body is greater than a length of the insertion portion extending from the sealing body.

9. The laundry treatment apparatus according to claim 1, wherein the door is rotatably coupled to a part of the tub cover located behind the introduction aperture, and wherein a front distance between an upper portion and a lower portion of the sealing body is greater than a rear distance between the upper portion and the lower portion of the sealing body.

10. The laundry treatment apparatus according to claim 9, further comprising:

a hinge that is configured to rotatably couple the door to the tub cover; and a locking unit that is configured to releasably couple a portion of the door to the tub cover, wherein, in a state in which the door is opened, a distance between an upper end and a lower end of the sealing body at a position adjacent to the locking unit is greater than a distance between the upper end and the lower end of the sealing body at a position adjacent to the hinge.

11. The laundry treatment apparatus according to claim 1, further comprising:

a hinge that is configured to rotatably couple the door to the tub cover; and a locking unit that is configured to releasably couple a portion of the door to the tub cover, wherein the sealing body includes a curved portion connecting an upper portion and a lower portion of the sealing body, and wherein a radius of curvature of the curved portion at a position adjacent to the locking unit is greater than a radius of curvature of the curved portion at a position adjacent to the hinge.

12. The laundry treatment apparatus according to claim 1, wherein the sealing unit further comprises a body fixing portion that extends from an upper portion of the sealing body and is coupled to the door.

13. The laundry treatment apparatus according to claim 1, wherein the sealing body has a C-shaped cross section having an open side toward a direction opposite to the introduction aperture.

14. The laundry treatment apparatus according to claim 13, wherein the C-shaped cross section of the sealing body comprises:

an upper portion located adjacent to the door;

a curved portion extending from the upper portion; and a lower portion extending from the curved portion, and wherein the upper portion is asymmetric with the lower portion.

15. The laundry treatment apparatus according to claim 1, wherein the sealing unit extends along a rim of the door and defines a closed curve along the rim of the door.

16. The laundry treatment apparatus according to claim 1, wherein the sealing body extends along a rim of the door, and wherein a width of an upper portion of the sealing body is greater than a width of a lower portion of the sealing body.

* * * * *